US009794719B2

(12) United States Patent
Chandran et al.

(10) Patent No.: US 9,794,719 B2
(45) Date of Patent: Oct. 17, 2017

(54) CROWD SOURCED AUDIO DATA FOR VENUE EQUALIZATION

(71) Applicant: Harman International Industries, Inc., Stamford, CT (US)

(72) Inventors: Sonith Chandran, Bangalore (IN); Sohan Madhav Bangaru, Bangalore (IN)

(73) Assignee: Harman International Industries, Inc., Stamford, CT (US)

( * ) Notice: Subject to any disclaimer, the term of this patent is extended or adjusted under 35 U.S.C. 154(b) by 0 days.

(21) Appl. No.: 14/739,051

(22) Filed: Jun. 15, 2015

(65) Prior Publication Data

US 2016/0366517 A1 Dec. 15, 2016

(51) Int. Cl.

| | |
|---|---|
| ***H04R 3/04*** | (2006.01) |
| ***H04S 7/00*** | (2006.01) |
| ***H04R 29/00*** | (2006.01) |
| *H04R 3/00* | (2006.01) |

(52) U.S. Cl.

CPC ..... *H04S 7/301* (2013.01); *H04R 29/007* (2013.01); *H04S 7/307* (2013.01); *H04R 3/005* (2013.01); *H04R 2227/007* (2013.01); *H04R 2499/11* (2013.01)

(58) Field of Classification Search

CPC ..... H04R 3/04; H04R 3/005; H04R 29/001; H04S 7/301; H04S 2400/13

See application file for complete search history.

(56) References Cited

U.S. PATENT DOCUMENTS

| | | | | |
|---|---|---|---|---|
| 5,131,051 | A * | 7/1992 | Kishinaga | H04R 27/00 381/63 |
| 7,483,540 | B2 * | 1/2009 | Rabinowitz | H04S 7/307 381/103 |
| 2012/0140936 | A1 | 6/2012 | Bonnick et al. | |
| 2012/0310396 | A1 | 12/2012 | Ojanpera | |
| 2013/0066453 | A1 | 3/2013 | Seefeldt | |
| 2014/0003625 | A1 * | 1/2014 | Sheen | H03G 5/005 381/103 |

(Continued)

FOREIGN PATENT DOCUMENTS

EP 2874414 A1 5/2015

OTHER PUBLICATIONS

European Search Report dated Dec. 2, 2016 in related European Patent Application No. 16171861.

(Continued)

*Primary Examiner* — Brenda Bernardi
(74) *Attorney, Agent, or Firm* — Brooks Kushman P.C.

(57) ABSTRACT

Mobile devices may capture audio signals indicative of test audio received by an audio capture device of the mobile device; and send the captured audio and the zone designation to a sound processor to determine equalization settings for speakers of the zone of the venue. An audio filtering device may receive the captured audio signals from the mobile devices; compare each of the captured audio signals with the test signal to determine an associated reliability of each of the captured audio signals; combine the captured audio signals into zone audio data; and transmit the zone audio data and associated reliability to a sound processor configured to determine equalization settings for the zone based on the captured audio signals and the test signal.

24 Claims, 4 Drawing Sheets

(56) References Cited

U.S. PATENT DOCUMENTS

| | | | | |
|---|---|---|---|---|
| 2014/0037097 | A1* | 2/2014 | Labosco | H04R 29/001 381/59 |
| 2014/0105406 | A1 | 4/2014 | Ojanpera | |
| 2014/0294201 | A1* | 10/2014 | Johnson | H03G 99/00 381/107 |
| 2015/0208184 | A1* | 7/2015 | Tan | H04R 29/00 381/58 |
| 2015/0256943 | A1* | 9/2015 | Inagaki | H04R 29/00 381/60 |

OTHER PUBLICATIONS

Extended European Search Report dated Feb. 23, 2017 in related European Patent Application No. 16171861.

* cited by examiner

CROWD SOURCED AUDIO DATA FOR VENUE EQUALIZATION

TECHNICAL FIELD

Aspects disclosed herein generally relate to collection of crowd-sourced equalization data for use in determining venue equalization settings.

BACKGROUND

Environmental speaker interactions may cause a frequency response of the speaker to change. In an example, as multiple speakers are added to a venue, the speaker outputs may constructively add or subtract at different locations, causing comb filtering or other irregularities. In another example, speaker outputs may suffer changed frequency response due to room interactions such as room coupling, reflections, and echoing. These effects may differ by venue and even by location within the venue.

Sound equalization refers to a technique by which amplitude of audio signals at particular frequencies is increased or attenuated. Sound engineers utilize equipment to perform sound equalization to correct for frequency response effects caused by speaker placement. To perform these corrections, the sound engineers may characterize the venue environment using specialized and expensive professional-audio microphones, and make equalization adjustments to the speakers to correct for the detected frequency response irregularities.

SUMMARY

In a first illustrative embodiment, an apparatus includes an audio filtering device configured to receive captured audio signals from a plurality of mobile devices located within a zone of a venue, the captured audio signals determined by audio capture devices of the respective mobile devices in response to receipt of test audio generated by speakers of the venue reproducing a test signal; combine the captured audio signals into zone audio data; and transmit the zone audio data to a sound processor configured to determine equalization settings for the zone based on the captured audio signals and the test signal.

In a second illustrative embodiment, a system includes a mobile device configured to identify a zone designation indicative of a zone of a venue in which the mobile device is located; capture audio signals indicative of test audio received by an audio capture device of the mobile device; and send the captured audio and the zone designation to a sound processor to determine equalization settings for speakers of the zone of the venue.

In a third illustrative embodiment, a non-transitory computer-readable medium is encoded with computer executable instructions, the computer executable instructions executable by a processor, the computer-readable medium comprising instructions configured to receive captured audio signals from a plurality of mobile devices located within a zone of a venue, the captured audio signals determined by audio capture devices of the respective mobile devices in response to receipt of test audio generated by speakers of the venue reproducing a test signal; compare each of the captured audio signals with the test signal to determine an associated match indication of each of the captured audio signals; combine the captured audio signals into zone audio data in accordance with the associated match indications; determine a usability score indicative of a number of captured audio signals combined into the zone audio data; and associate the zone audio data with the usability score; and transmit the zone audio data to a sound processor configured to determine equalization settings for the zone based on the captured audio signals and the test signal.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompany drawings in which:

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

A sound processor may include a test audio generator configured to provide a test signal, such as white noise, pink noise, a frequency sweep, a continuous noise signal, or some other audio signal. The test signal may be provided to one or more speakers of a venue to produce audio output. This audio output may be captured by one or more microphones at various points in the venue. The captured audio data may be returned to the sound processor via wired or wireless techniques, and analyzed to assist in the equalization of the speakers of the venue. The sound processor system may accordingly determine equalization settings to be applied to audio signals before they are applied to the speakers of the venue. In an example, the sound processor may detect frequencies that should be increased or decreased in amplitude in relation to the overall audio signal, as well as amounts of the increases or decreases. In large venues, multiple capture points, or zones, may be provided as input for the sound processor to analyze for proper equalization. For such a system to be successful, it may be desirable to avoid correcting for non-linearity or other response issues with the microphones themselves. As a result, such systems typically require the use of relatively high-quality and expensive professional-audio microphones.

An improved equalization system may utilize crowd-sourcing techniques to capture the audio output, instead of or in addition to the use of professional-audio microphones. In a non-limiting example, the system may be configured to receive audio data captured from a plurality of mobile devices having microphones, such as smartphones, tablets, wearable devices, and the like. The mobile devices may be assigned to zones of the venue, e.g., according to manual user input, triangulation or other location-based techniques. When the audio data is received, enhanced filtering logic may be used to determine a subset of the mobile devices deemed to be providing useful data. These useful signals may be combined to form zone audio for the zone of the venue, and may be passed to the sound processor for analysis. Thus, as explained in detail below, one or more of the professional-audio microphones may be replaced or augmented by a plurality of mobile devices having audio capture capabilities, without a loss in capture detail and equalization quality.

Figure 1:
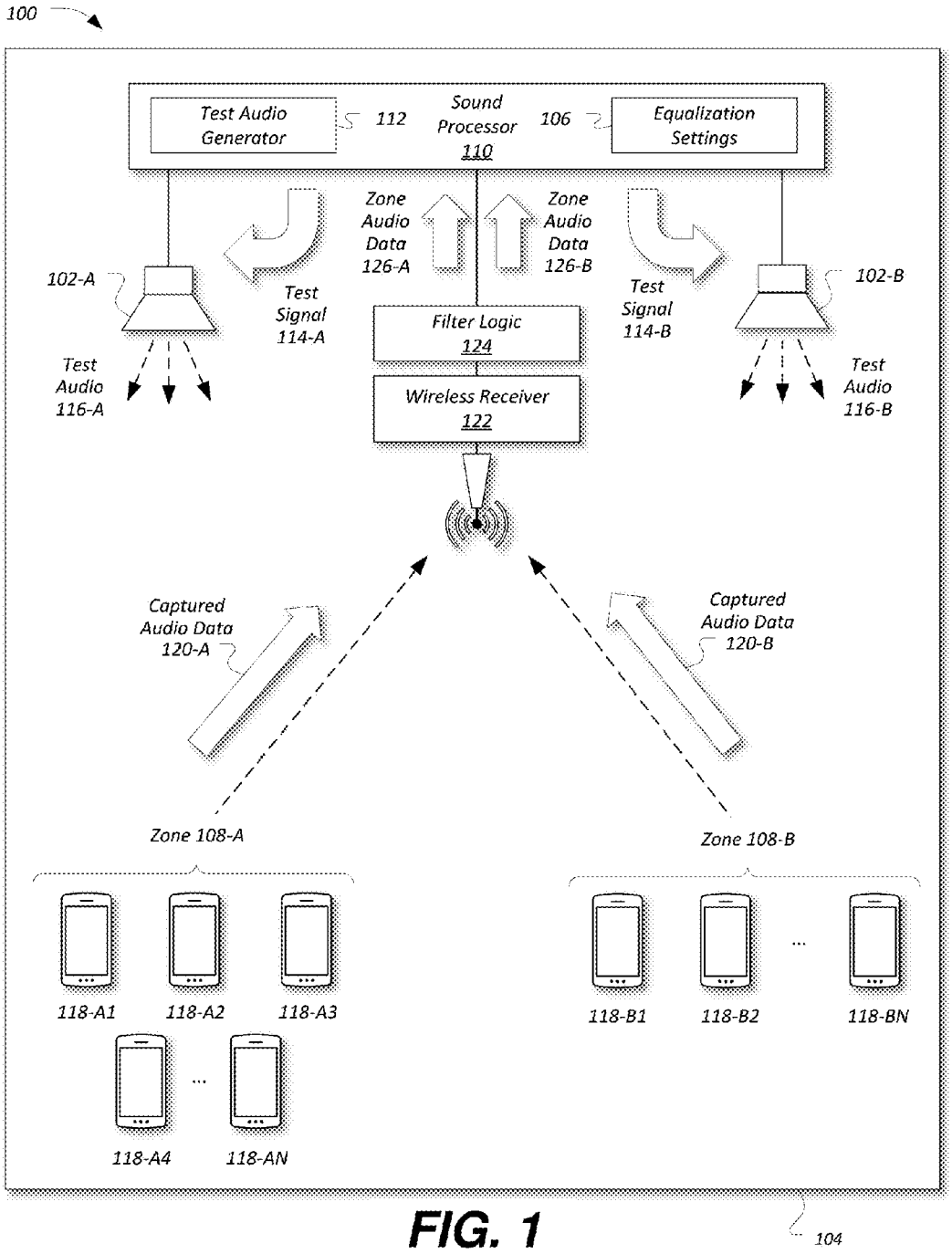
FIG. 1 illustrates an example diagram of a sound processor receiving audio data from a plurality of mobile devices, in accordance to one embodiment.

FIG. 1 illustrates an example system 100 including a sound processor 110 receiving captured audio data 120 from a plurality of mobile devices 118, in accordance to one embodiment. As illustrated, the system 100 includes a test audio generator 112 configured to provide test signals 114 to speakers 102 of the venue 104. The speakers may generate test audio 116 in the venue 104, which may be captured as captured audio data 120 by the mobile devices 118. The mobile devices 118 may transmit the captured audio data 120 to a wireless receiver 122, which may communicate the captured audio data 120 to filtering logic 124. The filtering logic 124 may, in turn, provide a zone audio data 126 compiled from a useful subset of the captured audio data 120 to the sound processor 110 to use in the computation of equalization settings 106 for the speakers 102. It should be noted that the illustrated system 100 is merely an example, and more, fewer, and/or differently located elements may be used.

The speakers 102 may be any of various types of devices configured to convert electrical signals into audible sound waves. As some possibilities, the speakers 102 may include dynamic loudspeakers having a coil operating within a magnetic field and connected to a diaphragm, such that application of the electrical signals to the coil causes the coil to move through induction and power the diaphragm. As some other possibilities, the speakers 102 may include other types of drivers, such as piezoelectric, electrostatic, ribbon or planar elements.

The venue 104 may include various types of locations having speakers 102 configured to provide audible sound waves to listeners. In an example, the venue may be a room or other enclosed area such as a concert hall, stadium, restaurant, auditorium, or vehicle cabin. In another example, the venue 104 may be an outdoor or at least partially-unenclosed area or structure, such as an amphitheater or stage. As shown, the venue 104 included two speakers, 102-A and 102-B. In other examples, the venue 104 may include more, fewer, and/or differently located speakers 102.

Audible sound waves generated by the speakers 102 may suffer changed frequency response due to interactions with the venue 104. These interactions may include, as some possibilities, room coupling, reflections, and echoing. The audible sound waves generated by the speakers 102 may also suffer changed frequency response due to interactions with the other speakers 102 of the venue 104. Notably, these effects may differ from venue 104 to venue 104, and even from location to location within the venue 104.

The equalization settings 106 may include one or more frequency response corrections configured to correct frequency response effects caused by the speaker 102 to venue 104 interactions and/or speaker 102 to speaker 102 interactions. These frequency response corrections may accordingly be applied as adjustments to audio signals sent to the speakers 102. In an example, the equalization settings 106 may include frequency bands and amounts of gain (e.g., amplification, attenuation) to be applied to audio frequencies that fall within the frequency bands. In another example, the equalization settings 106 may include one or more parametric settings that include values for amplitude, center frequency and bandwidth. In yet a further example, the equalization settings 106 may include semi-parametric settings specified according to amplitude and frequency, but with pre-set bandwidth of the center frequency.

The zones 108 may refer to various subsets of the locations within the venue 104 for which equalization settings 106 are to be assigned. In some cases, the venue 104 may be relatively small or homogenous, or may include one or very few speakers 102. In such cases, the venue 104 may include only a single zone 108 and a single set of equalization settings 106. In other cases, the venue 104 may include multiple different zones 108 each having its own equalization settings 106. As shown, the venue 104 included two zones 108, 108-A and 108-B. In other examples, the venue 104 may include more, fewer, and/or differently located zones 108.

The sound processor 110 may be configured to determine the equalization settings 106, and to apply the equalization settings 106 to audio signals provided to the speakers 102. To do so, in an example, the sound processor 110 may include a test audio generator 112 configured to generate test signals 114 to provide to the speakers 102 of the venue 104. As some non-limiting examples, the test signal 114 may include a white noise pulse, pink noise, a frequency sweep, a continuous noise signal, or some other predetermined audio signal. When the test signals 114 are applied to the inputs of the speakers 102, the speakers 102 may generate test audio 116. In the illustrated example, a first test signal 114-A is applied to the input of the speaker 102-A to generate test audio 116-A, and a second test signal 114-B is applied to the input of the speaker 102-B to generate test audio 116-B.

The system 100 may be configured to utilize crowd-sourcing techniques to capture the generated test audio 116, instead of or in addition to the use of professional-audio microphones. In an example, a plurality of mobile devices 118 having audio capture functionality may be configured to capture the test audio 116 into captured audio data 120, and send the captured audio data 120 back to the sound processor 110 for analysis. The mobile devices 118 may be assigned to zones 108 of the venue 104 based on their locations within the venue 104, such that the captured audio data 120 may be analyzed according to the zone 108 in which it was received. As some possibilities, the mobile devices 118 may be assigned to zones 108 according to manual user input, triangulation, global positioning, or other location-based techniques. In the illustrated example, first captured audio data 120-A is captured by the mobile devices 118-A1 through 118-AN assigned to the zone 108-A, and second captured audio data 120-B is captured by the mobile devices 118-B1 through 118-BN assigned to the zone 108-B. Further aspects of example mobile devices 118 are discussed below with respect to the FIGS. 2A and 2B.

The wireless receiver 122 may be configured to receive the captured audio data 120 as captured by the mobile devices 118. In an example, the mobile devices 118 may wirelessly send the captured audio data 120 to the wireless receiver 122 responsive to capturing the captured audio data 120.

The filter logic 124 may be configured to receive the captured audio data 120 from the wireless receiver 122, and process the captured audio data 120 to be in condition for processing by the sound processor 110. For instance, the filter logic 124 may be configured to average or otherwise combine the captured audio data 120 from mobile devices 118 within the zones 108 of the venue 104 to provide the sound processor 110 with overall zone audio data 126 for the zones 108. Additionally or alternately, the filter logic 124 may be configured to weight or discard the captured audio data 120 from one or more of the mobile devices 118 based on the apparent quality of the captured audio data 120 as received. In the illustrated example, the filter logic 124 processes the capture audio data 120-A into zone audio data 126-A for the zone 108-A and processes the capture audio data 120-B into zone audio data 126-B for the zone 108-B. Further aspects of the processing performed by the filter logic 124 are discussed in detail below with respect to FIG. 3. The sound processor 110 may accordingly use the zone audio data 126 instead of or in addition to audio data from professional microphones to determine the equalization settings 106.

Figure 2B:
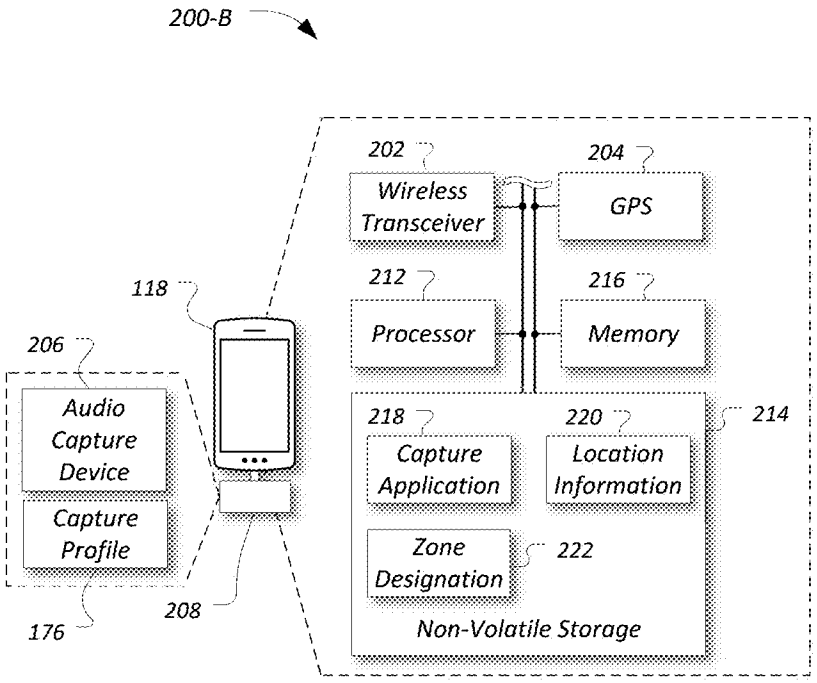
FIG. 2B illustrates an alternate example mobile device for capture of test audio, in accordance to one embodiment.
Figure 2A:
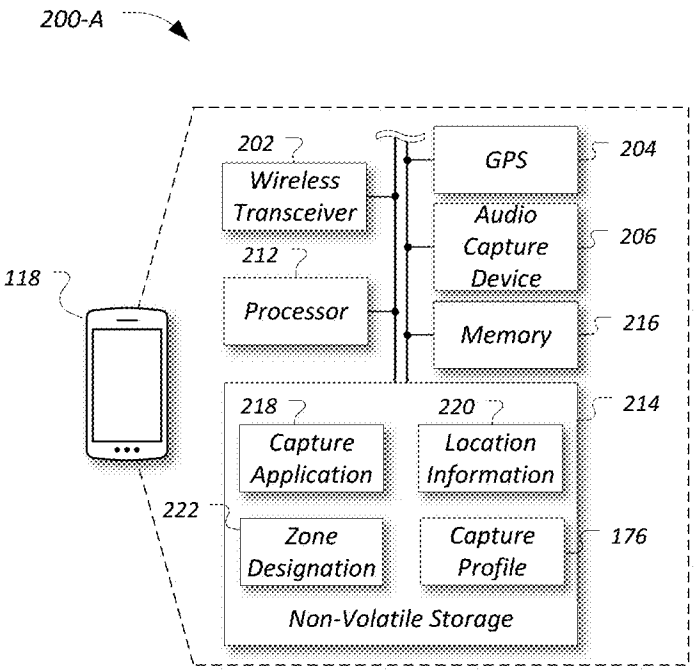
FIG. 2A illustrates an example mobile device for capture of test audio, in accordance to one embodiment.

FIG. 2A illustrates an example mobile device 118 having an integrated audio capture device 206 for the capture of test audio 116 in accordance to one embodiment. FIG. 2B illustrates an example mobile device 118 having a modular device 208 including the audio capture device 206 for the capture of test audio 116 in accordance to another embodiment.

The mobile device 118 may be any of various types of portable computing device, such as cellular phones, tablet computers, smart watches, laptop computers, portable music players, or other devices capable of communication with remote systems such as the sound processor 110. In an example, the mobile device 118 may include a wireless transceiver 202 (e.g., a BLUETOOTH module, a ZIGBEE transceiver, a Wi-Fi transceiver, an IrDA transceiver, an RFID transceiver, etc.) configured to communicate with the wireless receiver 122. Additionally or alternately, the mobile device 118 may communicate with the other devices over a wired connection, such as via a USB connection between the mobile device 118 and the other device. The mobile device 118 may also include a global positioning system (GPS) module 204 configured to provide current mobile device 118 location and time information to the mobile device 118.

The audio capture device 206 may be a microphone or other suitable device configured to convert sound waves into an electrical signal. In some cases, the audio capture device 206 may be integrated into the mobile device 118 as illustrated in FIG. 2A, while in other cases the audio capture device 206 may be integrated into a modular device 208 pluggable into the mobile device 118 (e.g., into a universal serial bus (USB) or other port of the mobile device 118) as illustrated in FIG. 2B. If the model or type of the audio capture device 206 is identified by the mobile device 118 (e.g., based on its inclusion in a known mobile device 118 or model of connected capture device 208), the mobile device 118 may be able to identify a capture profile 210 to compensate for irregularities in the response of the audio capture device 206. Or, the modular device 208 may store and make available the capture profile 210 for use by the connected mobile device 118. Regardless of from where the capture profile 210 is retrieved, the capture profile 210 may include data based on a previously performed characterization of the audio capture device 206. The mobile device 118 may utilize the capture profile 210 to adjust levels of electrical signal received from the audio capture device 206 to include in the captured audio data 120 in order to avoid computing equalization setting 106 compensations for irregularities of the audio capture device 206 itself, not of the venue 104.

The mobile device 118 may include one or more processors 212 configured to perform instructions, commands and other routines in support of the processes described herein. Such instructions and other data may be maintained in a non-volatile manner using a variety of types of computer-readable storage medium 214. The computer-readable medium 214 (also referred to as a processor-readable medium or storage) includes any non-transitory medium (e.g., a tangible medium) that participates in providing instructions or other data to a memory 216 that may be read by the processor 212 of the mobile device 118. Computer-executable instructions may be compiled or interpreted from computer programs created using a variety of programming languages and/or technologies, including, without limitation, and either alone or in combination, Java, C, C++, C#, Objective C, Fortran, Pascal, Java Script, Python, Perl, and PL/SQL.

An audio capture application 218 may be an example of an application installed to the storage 214 of the mobile device 118. The audio capture application 218 may be configured to utilize the audio capture device 206 to receive captured audio data 120 corresponding to the test signal 114 as received by the audio capture device 206. The audio capture application 218 may also utilize a capture profile 210 to update the captured audio data 120 to compensate for irregularities in the response of the audio capture device 206.

The audio capture application 218 may be further configured to associate the captured audio data 120 with metadata. In an example, the audio capture application 218 may associate the captured audio data 120 with location information 220 retrieved from the GPS module 204 and/or a zone designation 222 retrieved from the storage 214 indicative of the assignment of the mobile device 118 to a zone 108 of the venue 104. In some cases, the zone designation 222 may be input by a user to the audio capture application 218, while in other cases the zone designation 222 may be determined based on the location information 220. The audio capture application 218 may be further configured to cause the mobile device 118 to send the resultant captured audio data 120 to the wireless receiver 122, which in turn may provide the captured audio data 120 to the filter logic 124 for processing into zone audio data 126 to be provided to the sound processor 110.

Referring back to FIG. 1, the filter logic 124 may be configured to process the captured audio data 120 signals received from the audio capture devices 206 of the mobile devices 118. In some implementations, the filter logic 124 and/or wireless receiver 122 may be included as components of an improved sound processor 110 that is enhanced to implement the filter logic 124 functionality described herein. In other implementations, the filter logic 124 and wireless receiver 122 may be implemented as a hardware module separate from and configured to provide the zone audio data 126 to the sound processor 110, allowing for use of the filter logic 124 functionality with an existing sound processor 110. As a further example, the filter logic 124 and wireless receiver 122 may be implemented as a master mobile device 118 connected to the sound processor 110, and configured to communicate to the other mobile devices 118 (e.g., via WiFi, BLUETOOTH, or another wireless technology). In such an example, the processing of the filter logic 124 may be performed by an application installed to the master mobile device 118, e.g., the capture application 218 itself, or another application.

Regardless of the specifics of the implementation, the filter logic 124 may be configured to identify zone designations 222 from the metadata of the received captured audio data 120, and classify the captured audio data 120 belonging to each zone 108. The filter logic 124 may accordingly process the captured audio data 120 by zone 108, and may provide an overall zone audio data 126 signal for each zone 108 to the sound processor 110 for use in computation of equalization settings 106 for the speakers 102 directed to provide sound output to the corresponding zone 108.

In an example, the filter logic 124 may analyze the captured audio data 120 to identify subsections of the captured audio data 120 that match to one another across the various captured audio data 120 signals received from the audio capture devices 206 of the zone 108. The filter logic 124 may accordingly perform time alignment and other pre-processing of the received captured audio data 120 in an attempt to cover the entire time of the provisioning of the test audio signal 114 to speakers 102 of the venue 104.

The filter logic 124 may be further configured to, analyze the matching and aligned captured audio data 120 in comparison to corresponding parts of the test audio signal 114. Where the captured audio data 120 matches as being related to the test audio signal 114, the captured audio data 120 may be combined and sent to the sound processor 110 for use in determination of the equalization settings 106. Or, if there is no match to the test audio signal 114, the filter logic 124 may add error-level information to the captured audio data 120 (e.g., as metadata) to allow the sound processor 110 to identify regions of the captured audio data 120 which should be considered relatively less heavily in the determination of the equalization settings 106.

Figure 3:
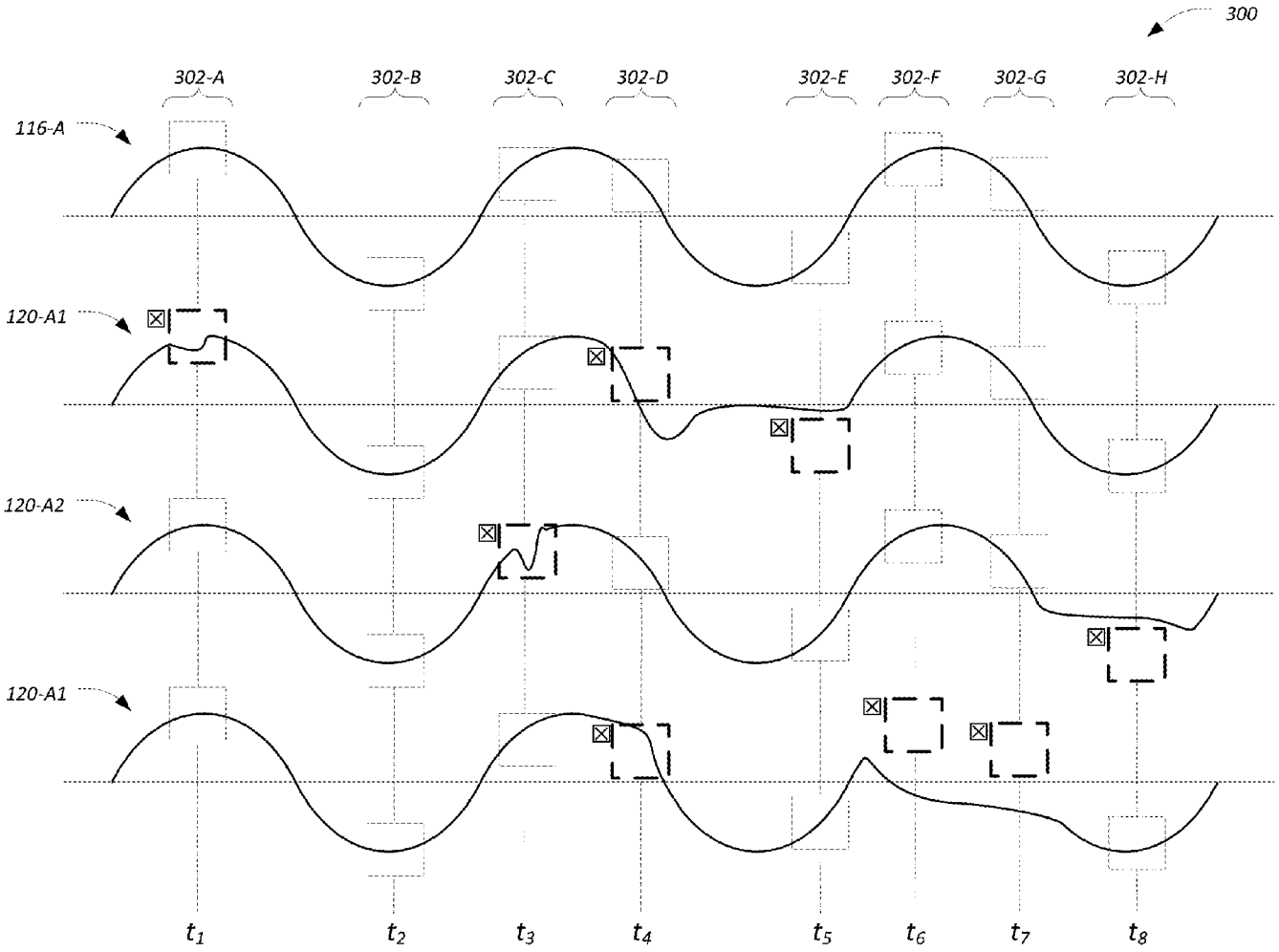
FIG. 3 illustrates an example matching of captured audio data to be in condition for processing by the sound processor.

FIG. 3 illustrates an example matching 300 of captured audio data 120 to be in condition for processing by the sound processor 110. As shown, the example matching 300 includes an illustration of generated test audio 116 as a reference, as well as aligned captured audio data 120 received from multiple mobile devices 118 within a zone 108. In an example, the captured audio data 120-A may be received from the mobile device 118-A1 of zone 108-A, the captured audio data 120-B may be received from the mobile device 118-A2 of zone 108-A, and the captured audio data 120-C may be received from the mobile device 118-A3 of zone 108-A. It should be noted that the illustrated matching 300 is merely an example, and more, fewer, and/or different captured audio data 120 may be used.

To process the captured audio data 120, the filter logic 124 may be configured to perform a relative/differential comparison of the captured audio data 120 in relation to the generated test audio 116 reference signal. These comparisons may be performed at a plurality of time indexes 302 during the audio capture. Eight example time indexes 302-A through 302-H (collectively 302) are depicted in the FIG. 3 at various intervals in time (i.e., $t_1$, $t_2$, $t_3$, . . . , $t_8$). In other examples, and more, fewer, and/or different time indexes 302 may be used. In some cases, the time indexes 302 may be placed at periodic intervals of the generated test audio 116, while in other cases, the time indexes 302 may be placed at random intervals during the generated test audio 116.

The comparisons at the time indexes 302 may result in a match when the captured audio data 120 during the time index 302 is found to include the generated test audio 116 signal. The comparisons at the time indexes 302 may result in a non-match when the captured audio data 120 during the time index 302 is not found to include the generated test audio 116 signal. As one possibility, the comparison may be performed by determining an audio fingerprint for the test audio 116 signal and also audio fingerprints for each of the captured audio data 120 signals during the time index 302. The audio fingerprints may be computed, in an example, by splitting each of the audio signals to be compared into overlapping frames, and then applying a Fourier transformation (e.g., a short-time Fourier transform (STFT)) to determine the frequency and phase content of the sections of a signal as it changes over time. In a specific example, the audio signals may be converted using a sampling rate of 11025 Hz, a frame size of 4096, and with ⅔ frame overlap. To determine how closely the audio samples match, the filter logic 124 may compare each of the captured audio data 120 fingerprints to the test audio 116 fingerprint, such that those fingerprints matching by at least a threshold amount are considered to be a match.

In the illustrated example, the captured audio data 120-A1 matches the generated test audio 116 at the time indexes 302 ($t_2$, $t_3$, $t_6$, $t_7$, $t_8$) but not at the time indexes 302 ($t_1$, $t_4$, $t_5$). The captured audio data 120-A2 matches the generated test audio 116 at the time indexes 302 ($t_1$, $t_2$, $t_4$, $t_5$, $t_6$, $t_7$) but not at the time indexes 302 ($t_3$, $t_8$). The captured audio data 120-A3 matches the generated test audio 116 at the time indexes 302 ($t_1$, $t_2$, $t_3$, $t_5$, $t_8$) but not at the time indexes 302 ($t_4$, $t_6$, $t_7$).

The filter logic 124 may be configured to determine reliability factors for the captured audio data 120 based on the match/non-match statues, and usability scores for the captured audio data 120 based on the reliability factors. The usability scores may accordingly be used by the filter logic 124 to determine the reliability of the contributions of the captured audio data 120 to the zone audio data 126 to be processed by the sound processor 110.

The filter logic 124 may be configured to utilize a truth table to determine the reliability factors. In an example, the truth table may equally weight contributions of the captured audio data 120 to the zone audio data 126. Such an example may be utilized in situations in which the zone audio data 126 is generates as an equal mix of each of the captured audio data 120 signals. In other examples, when the captured audio data 120 signals may be mixed in different proportions to one another, the truth table may include weight contributions of the captured audio data 120 to the zone audio data 126 in accordance to their contributions within the overall zone audio data 126 mix.

Table 1 illustrates an example reliability factor contribution for a zone 108 including two captured audio data 120 signals (n=2) having equal weights.

TABLE 1

| n = 2 | | | Reliability |
|---|---|---|---|
| Input 1 | Input 2 | Acceptance | Factor r |
| X | X | x | 0% |
| X | M | ✓ | 50% |
| M | X | ✓ | 50% |
| M | M | ✓ | 100% |

As shown in the Table 1, if neither of the captured audio data 120 matches, then the reliability factor is 0%, and the zone audio data 126 may be disregarded in computation of equalization settings 106 by the sound processor 110. If either but not both of the captured audio data 120 signals matches, then the zone audio data 126 may be considered in the computation of equalization settings 106 by the sound processor 110 with a reliability factor of 50%. If both of the captured audio data 120 signals match, then the zone audio data 126 may be considered in the computation of the equalization settings 106 by the sound processor 110 with a reliability factor of 100%.

Table 2 illustrates an example reliability factor contribution for a zone 108 including three captured audio data 120 signals (n=3) having equal weights.

TABLE 2

| n = 3 | | | | Reliability |
|---|---|---|---|---|
| Input 1 | Input 2 | Input 3 | Acceptance | Factor r |
| X | X | X | x | 0% |
| X | X | M | ✓ | 33% |
| X | M | X | ✓ | 33% |
| X | M | M | ✓ | 66% |
| M | X | X | ✓ | 33% |
| M | X | M | ✓ | 66% |
| M | M | X | ✓ | 66% |
| M | M | M | ✓ | 100% |

As shown in the Table 2, if none of the captured audio data 120 matches, then the reliability factor is 0%, and the zone audio data 126 may be disregarded in computation of equalization settings 106 by the sound processor 110. If one of the captured audio data 120 signals matches, then the zone audio data 126 may be considered in the computation of equalization settings 106 by the sound processor 110 with a reliability factor of 33%. If two of the captured audio data 120 signals matches, then the zone audio data 126 may be considered in the computation of equalization settings 106 by the sound processor 110 with a reliability factor of 66%. If all of the captured audio data 120 signals match, then the zone audio data 126 may be considered in the computation of equalization settings 106 by the sound processor 110 with a reliability factor of 100%.

The filter logic 124 may be further configured to determine a usability score (U) based on the reliability factor as follows:

$$\text{Usability Score } (U) = \text{Reliability Factor } (r) * \text{No. of Inputs } (n) \quad (1)$$

In an example, for a situation in which two out of three captured audio data 120 signals match, a usability score (U) of 2 may be determined. Accordingly, as the number of captured audio data 120 signal inputs, the usability of the zone audio data 126 correspondingly increases. Thus, using the equation (1) as an example usability score computation, the number of matching captured audio data 120 may be directly proportional to the reliability factor (r). Moreover, the greater the usability score (U), the better the performance of the equalization performed by the sound processor 110 using the audio captured by the mobile devices 118. The usability score (U) may accordingly be provided by the filter logic 124 to the sound processor 110, to allow the sound processor 110 to weight the zone audio data 126 in accordance with the identified usability score (U).

Figure 4:
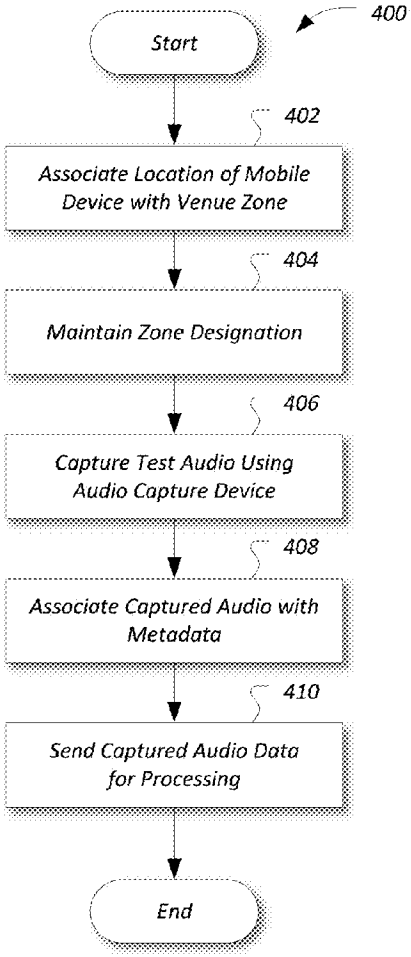
FIG. 4 illustrates an example process for capturing audio data by the mobile devices located within the venue, in accordance to one embodiment.

FIG. 4 illustrates an example process 400 for capturing audio data by the mobile devices 118 located within the venue 104. In an example, the process 400 may be performed by the mobile device 118 to capture audio data 120 for the determination of equalization settings 106 for the venue 104.

At operation 402, the mobile device 118 associates a location of the mobile device 118 with a zone 108 of the venue 104. In an example, the audio capture application 218 of the mobile device 118 may utilize the GPS module 204 to determine coordinate location information 220 of the mobile device 118, and may determine a zone designation 222 indicative of the zone 108 of the venue 104 in which the mobile device 118 is located based on coordinate boundaries of different zones 108 of the venue 104. In another example, the audio capture application 218 may utilize a triangulation technique to determine location information 220 related to the position of the mobile device 118 within the venue 104 in comparison to that of wireless receivers of known locations within the venue 104. In yet another example, the audio capture application 218 may provide a user interface to a user of the mobile device 118, and may receive input from the user indicating the zone designation 222 of the mobile device 118 within the venue 104. In some cases, multiple of these techniques may be combined. For instance, the audio capture application 218 may determine a zone designation 222 indicative of the zone 108 in which the mobile device 118 is located using GPS or triangulation location information 220, and may provide a user interface to the user to confirm or receive a different zone designation 222 assignment.

At operation 404, the mobile device 118 maintains the zone designation 222. In an example, the audio capture application 218 may save the determined zone designation 222 to storage 214 of the mobile device 118.

At operation 406, the mobile device 118 captures audio using the audio capture device 206. In an example, the audio capture application 218 may utilize the audio capture device 206 to receive captured audio data 120 corresponding to the test signal 114 as received by the audio capture device 206. The audio capture application 218 may also utilize a capture profile 210 to update the captured audio data 120 to compensate for irregularities in the response of the audio capture device 206.

At operation 408, the mobile device 118 associates the captured audio data 120 with metadata. In an example, the audio capture application 218 may associate the captured audio data 120 with the determined zone designation 222 to allow the captured audio data 120 to be identified as having been captured within the zone 108 in which the mobile device 118 is associated.

At operation 410, the mobile device 118 sends the captured audio data 120 to the sound processor 110. In an example, the audio capture application 218 may utilize the wireless transceiver 202 of the mobile device 118 to send the captured audio data 120 to the wireless receiver 122 of the sound processor 110. After operation 410, the process 400 ends.

Figure 5:
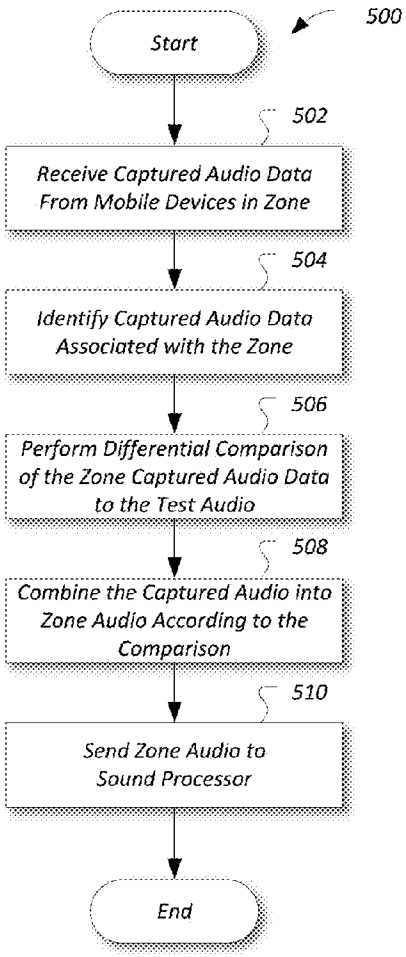
FIG. 5 illustrates an example process for processing captured audio data for use by the sound processor, in accordance to one embodiment.

FIG. 5 illustrates an example process 500 for processing captured audio data 120 for use by the sound processor 110. In an example, the process 500 may be performed by the filtering logic 124 in communication with the wireless receiver 122 and sound processor 110.

At operation 504, the filtering logic 124 receives captured audio data 120 from a plurality of mobile devices 118. In an example, the filtering logic 124 may receive the captured audio data 120 sent from the mobile devices 118 as described above with respect to the process 400.

At operation 506, the filtering logic 124 processes the captured audio data 120 into zone audio data 126. In an example, the filtering logic 124 may identify the captured audio data 120 for a particular zone 108 according to zone designation 222 data included in the metadata of the captured audio data 120. The filtering logic 124 may be further configured to align the captured audio data 120 received from multiple mobile devices 118 within the zone 108 to account for sound travel time to facilitate comparison of the captured audio data 120 captured within the zone 108.

At operation 508, the filtering logic 124 performs differential comparison of the captured audio data 120. In an example, the filtering logic 124 may perform comparisons at a plurality of time indexes 302 to identify when the captured audio data 120 during the time index 302 is found to include the generated test audio 116 signal. As one possibility, the comparison may be performed by determining audio fingerprints for the test audio 116 signal and each of the captured audio data 120 signals during the time index 302, and performing a correlation to identify which captured audio data 120 meets at least a predetermined matching threshold to indicate a sufficient matching in content. The filter logic 124 may be further configured to determine reliability factors and/or usability factors for the captured audio data 120 based on the count of the match/non-match statuses.

At operation 510, the filtering logic 124 combines the captured audio data 120 into zone audio data 126. In an example, the filtering logic 124 may be configured to combine only those of the captured audio data 120 determined to match the test audio 116 into the zone audio data 126. The filtering logic 124 may further associate the combined zone audio data 126 with a usability score and/or reliability factor indicative of how well the captured audio data 120 that was combined matched in the creation of the zone audio data 126 (e.g., how many mobile devices 118 contributed to which portions of the zone audio data 126). For instance, a portion of the zone audio data 126 sourced from three mobile devices 118 may be associated with a higher usability score than another portion of the zone audio data 126 sourced from one or two mobile devices 118.

At operation 512, the filtering logic 124 sends the zone audio data 126 to the sound processor 110 for use in the computation of equalization settings 106. After operation 512, the process 500 ends.

Figure 6:
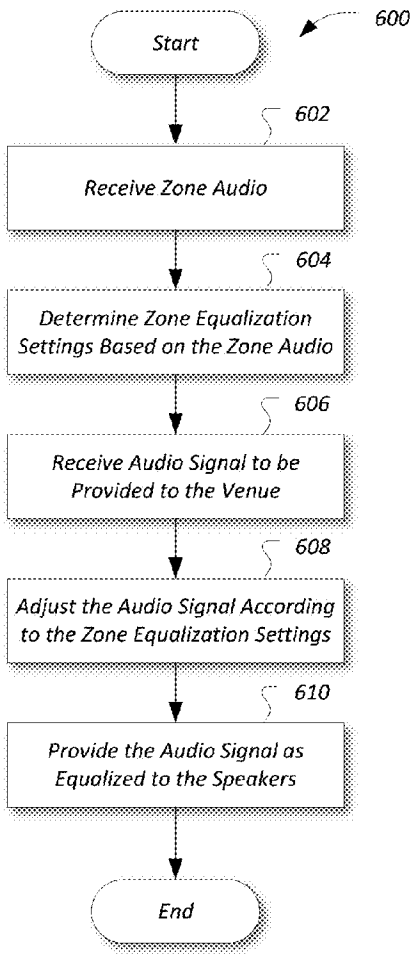
FIG. 6 illustrates an example process for utilizing zone audio data to determine equalization settings to apply audio signals provided to speakers providing audio to the zone of the venue, in accordance to one embodiment.

FIG. 6 illustrates an example process 600 for utilizing zone audio data 126 to determine equalization settings 106 to apply audio signals provided to speakers 102 providing audio to the zone 108 of the venue 104. In an example, the process 600 may be performed by the sound processor 110 in communication with the filtering logic 124.

At operation 602, the sound processor 110 receives the zone audio data 126. In an example, the sound processor 110 may receive the zone audio data 126 sent from the filtering logic 124 as described above with respect to the process 500. At operation 604, the sound processor 110 determines the equalization settings 106 based on the zone audio data 126. These equalization settings 106 may address issues such as room modes, boundary reflections, and spectral deviations.

At operation 606, the sound processor 110 receives an audio signal. In an example, the sound processor 110 may receive audio content to be provided to listeners in the venue 104. At operation 608, the sound processor 110 adjusts an audio signal according to the equalization settings 106. In an example, the sound processor 110 may utilize the equalization settings 106 to adjust the received audio content in accordance to address the identified issues within the venue 104.

At operation 610, the sound processor 110 provides the adjusted audio signal to speakers 102 of the zone 108 of the venue 104. Accordingly, the sound processor 110 may utilize audio captured by mobile devices 118 within the zones 108 for use in determination of equalization settings 106 for the venue 104, without requiring the user of professional-audio microphones or other specialized sound capture equipment. After operation 610, the process 600 ends.

Computing devices described herein, such as the sound processor 110, filtering logic 124 and mobile devices 118, generally include computer-executable instructions, where the instructions may be executable by one or more computing devices such as those listed above. Computer-executable instructions may be compiled or interpreted from computer programs created using a variety of programming languages and/or technologies, including, without limitation, and either alone or in combination, Java™, C, C++, Visual Basic, Java Script, Perl, etc. In general, a processor (e.g., a microprocessor) receives instructions, e.g., from a memory, a computer-readable medium, etc., and executes these instructions, thereby performing one or more processes, including one or more of the processes described herein. Such instructions and other data may be stored and transmitted using a variety of computer-readable media.

With regard to the processes, systems, methods, heuristics, etc., described herein, it should be understood that, although the steps of such processes, etc., have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claims.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An apparatus comprising:

an audio filtering device configured to receive captured audio signals from a plurality of mobile devices located within a zone of a venue, the captured audio signals determined by audio capture devices of the respective mobile devices in response to receipt of test audio generated by speakers of the venue reproducing a test signal, wherein each of the captured audio signals includes a respective zone designation indicative of the zone of the venue within which the respective captured audio signal was captured;

combine the captured audio signals into zone audio data;

determine a usability score indicative of a number of captured audio signals combined into the zone audio data;

associate the zone audio data with the usability score; and send the zone audio data to a sound processor configured to determine equalization settings for the zone based on the captured audio signals and the test signal.

2. The apparatus of claim 1, wherein the equalization settings include one or more frequency response corrections configured to correct frequency response effects caused by at least one of speaker-to-venue interactions and speaker-to-speaker interactions.

3. The apparatus of claim 1, wherein the mobile devices are assigned to the zones according to manual user input to the respective mobile devices.

4. The apparatus of claim 1, wherein the mobile devices are assigned to the zones according to triangulation.

5. The apparatus of claim 1, wherein the audio filtering device is further configured to:

compare each of the captured audio signals with the test signal to determine which captured audio signals include the test signal; and combine only the captured audio signals identified as including the test signal into the zone audio data.

6. The apparatus of claim 1, wherein the audio filtering device is further configured to:

determine a first usability score according to a comparison of a first time index of the respective captured audio signal with a corresponding first time index of the test audio;

associate zone audio data associated with the first time index with the first usability score;

determine a second usability score according to a comparison of a second time index of the respective captured audio signal with a corresponding second time index of the test audio; and associate zone audio data associated with the second time index with the second usability score.

7. The apparatus of claim 1, wherein the audio filtering device is further configured to:

combine second captured audio signals from a second plurality of mobile devices located within a second zone of the venue into second zone audio data;

associate the zone audio data with a first usability score determined according to a comparison of a time index of the respective captured audio signal with a corresponding time index of the test audio; and associate the second zone audio data with a second usability score determined according to a comparison of the time index of the respective second captured audio signal with the corresponding time index of the test audio.

8. The apparatus of claim 1, wherein the audio filtering device is further configured to perform time alignment of the captured audio signals to one another before comparing each of the captured audio signals with the test audio.

9. The apparatus of claim 1, wherein the audio filtering device is at least one of integrated with the sound processor and a mobile device in communication with the sound processor.

10. An apparatus comprising:

a mobile device configured to identify a zone designation indicative of a zone of a venue in which the mobile device is located;

capture audio signals indicative of test audio received by an audio capture device of the mobile device; and transmit the captured audio and the zone designation to a sound processor to determine equalization settings for speakers of the zone of the venue, wherein the audio capture device is included in a module device plugged into a port of the mobile device.

11. The apparatus of claim 10, wherein the mobile device is further configured to identify the zone designation according to at least one of: user input to a user interface of the mobile device, global positioning data received from a global positioning data receiver, and triangulation of wireless signals transmitted by the mobile device.

12. The apparatus of claim 10, wherein the mobile device is further configured to utilize a capture profile to update the captured audio to compensate for irregularities in audio response of the audio capture device.

13. The apparatus of claim 12, wherein the audio capture device is integrated into the mobile device, and the capture profile of the audio capture device is stored by the mobile device.

14. A non-transitory computer-readable medium encoded with computer executable instructions, the computer executable instructions executable by a processor, the computer-readable medium comprising instructions configured to:

receive captured audio signals from a plurality of mobile devices located within a zone of a venue, the captured audio signals determined by audio capture devices of the respective mobile devices in response to receipt of test audio generated by speakers of the venue reproducing a test signal;

compare each of the captured audio signals with the test signal to determine an associated match indication of each of the captured audio signals;

combine the captured audio signals into zone audio data in accordance with the associated match indications;

determine a usability score indicative of a number of captured audio signals combined into the zone audio data; and associate the zone audio data with the usability score; and transmit the zone audio data to a sound processor configured to determine equalization settings for the zone based on the captured audio signals and the test signal.

15. The medium of claim 14, wherein each of the captured audio signals include a respective zone designation indicative of the zone of the venue within which the respective captured audio signals was captured.

16. The medium of claim 14, wherein the equalization settings include one or more frequency response corrections configured to correct frequency response effects caused by at least one of speaker-to-venue interactions and speaker-to-speaker interactions.

17. The medium of claim 14, wherein the associated match indication of each of the captured audio signals is determined according to a comparison of a time index of the respective captured audio signal with a corresponding time index of the test audio.

18. An apparatus comprising:

an audio filtering device configured to receive captured audio signals from a plurality of mobile devices located within a zone of a venue, the captured audio signals determined by audio capture devices of the respective mobile devices in response to receipt of test audio generated by speakers of the venue reproducing a test signal;

combine the captured audio signals into zone audio data;

determine a usability score indicative of a number of captured audio signals combined into the zone audio data;

associate the zone audio data with the usability score; and send the zone audio data to a sound processor configured to determine equalization settings for the zone based on the captured audio signals and the test signal, wherein the mobile devices are assigned to the zones according to one or more of: triangulation or manual user input to the respective mobile devices.

19. The apparatus of claim 18, wherein the equalization settings include one or more frequency response corrections configured to correct frequency response effects caused by at least one of speaker-to-venue interactions and speaker-to-speaker interactions.

20. The apparatus of claim 18, wherein the audio filtering device is further configured to:

compare each of the captured audio signals with the test signal to determine which captured audio signals include the test signal; and combine only the captured audio signals identified as including the test signal into the zone audio data.

21. The apparatus of claim 18, wherein the audio filtering device is further configured to:

determine a first usability score according to a comparison of a first time index of the respective captured audio signal with a corresponding first time index of the test audio;

associate zone audio data associated with the first time index with the first usability score;

determine a second usability score according to a comparison of a second time index of the respective captured audio signal with a corresponding second time index of the test audio; and associate zone audio data associated with the second time index with the second usability score.

22. The apparatus of claim 18, wherein the audio filtering device is further configured to:

combine second captured audio signals from a second plurality of mobile devices located within a second zone of the venue into second zone audio data;

associate the zone audio data with a first usability score determined according to a comparison of a time index of the respective captured audio signal with a corresponding time index of the test audio; and associate the second zone audio data with a second usability score determined according to a comparison of the time index of the respective second captured audio signal with the corresponding time index of the test audio.

23. The apparatus of claim 18, wherein the audio filtering device is further configured to perform time alignment of the captured audio signals to one another before comparing each of the captured audio signals with the test audio.

24. The apparatus of claim 18, wherein the audio filtering device is at least one of integrated with the sound processor and a mobile device in communication with the sound processor.

* * * * *